US005223091A

United States Patent [19]

Hetzler et al.

[11] Patent Number: 5,223,091

[45] Date of Patent: Jun. 29, 1993

[54] METHOD OF BRIGHTENING MECHANICAL PULP USING SILICATE-FREE PEROXIDE BLEACHING

[75] Inventors: Bernard H. Hetzler, Surrey; Donald T. Eadie, North Vancouver; James K. Turnbull, West Vancouver, all of Canada

[73] Assignee: MacMillan Bloedel Limited, Vancouver, Canada

[21] Appl. No.: 796,951

[22] Filed: Nov. 25, 1991

[51] Int. Cl.[5] ..... D21C 1/04

[52] U.S. Cl. ..... 162/76; 162/78; 162/79; 162/76; 162/80; 162/82; 162/86

[58] Field of Search ..... 162/78, 79, 76, 80, 162/82, 86

[56] References Cited

U.S. PATENT DOCUMENTS

| | | | |
|---|---|---|---|
| 2,820,690 | 1/1958 | Feldman | 162/78 |
| 3,860,391 | 1/1975 | Kling et al. | 162/78 |
| 4,614,646 | 9/1986 | Christiansen | 162/78 |
| 4,731,161 | 3/1988 | Erhardt | 162/78 |
| 4,732,650 | 3/1988 | Michalowski et al. | 162/76 |
| 4,798,652 | 1/1989 | Joyce et al. | 162/78 |
| 4,849,053 | 7/1989 | Gentile, Jr. et al. | 162/78 |
| 4,859,283 | 8/1989 | Jayawant | 162/78 |
| 4,915,785 | 4/1990 | Siminoski et al. | 162/78 |
| 4,938,842 | 7/1990 | Whiting et al. | 162/80 |
| 4,946,556 | 8/1990 | Prough | 162/76 |

FOREIGN PATENT DOCUMENTS

| | | |
|---|---|---|
| 686115 | 5/1965 | Canada . |
| 78-44564 | 11/1978 | Japan . |

OTHER PUBLICATIONS

Factors Affecting $H_2O_2$ stability in the Brightening of mech. & chemi-mechanical pulps. Part III: $H_2O_2$ stability in the presence of Mg & combinations of Stabilizers, Colodette, J. L. Rothenberg, S.; Deuce, C. W., from the Journal of Pulp and Paper Science: vol. 15, No. 2, Mar. 1989.

*Primary Examiner*—W. Gary Jones
*Assistant Examiner*—Dean Tan Nguyen
*Attorney, Agent, or Firm*—C. A. Rowley

[57] ABSTRACT

A method of brightening mechanical pulps by chelating and thickening to reduce the manganese content of the pulp to less than 30 parts per million and copper content less than 1 parts per million by adding ions preferably magnesium ions as magnesium sulphate $MgSO_4$ in the amount of 400 to 3,000 ppm Mg ions retained by the pulp based on the oven dry weight of the pulp and thereafter applying a bleaching liquor composed of peroxide as hydrogen peroxide and an alkali as sodium hydroxide having a ratio of alkali to peroxide of between 1—1 and 2-1 in an amount to apply between 1 to 8 percent peroxide based on the oven dry weight of the pulp and containing no added sodium silicate. Preferably the bleaching liquor will contain magnesium sulphate in the amount of about 0.001 to 0.1% based on the oven dry weight of the pulp. The treated pulp is bleached in a bleaching tower for a sufficient time to obtain the desired degree of brightening and thereby produce a pulp having a brightness at least equivalent to that obtained by bleaching using a silicate stabilized bleaching liquor and the equivalent amount of peroxide.

28 Claims, 7 Drawing Sheets

METHOD OF BRIGHTENING MECHANICAL PULP USING SILICATE-FREE PEROXIDE BLEACHING

FIELD OF THE INVENTION

The present invention relates to a process for bleaching of mechanical pulps with peroxide free of sodium silicate while obtaining at least as high an improvement in brightness for an equivalent amount of peroxide application as obtained with the conventional silicate stabilized peroxide process.

BACKGROUND OF THE PRESENT INVENTION

The conventional procedure in bleaching mechanical pulp using hydrogen peroxide (peroxide) is to form a bleaching liquor composed of sodium silicate, magnesium sulphate, sodium hydroxide and hydrogen peroxide by sequential addition in the required proportions to produce a bleaching liquor that is thereafter applied to the pulp. The bleaching is generally carried out at a consistency in a range of about 7 to 40% at an elevated temperature, e.g. 60° C. for a period of time in the order of about 1 to 4 hours. The bleached pulp is then optionally soured and used for the formation of paper or production of market mechanical pulps.

In some cases the residual bleaching chemicals are separated from the bleached pulp and the residual hydrogen peroxide used to pretreat the incoming pulp or to treat a different fraction of the pulp.

It has also been proposed to bleach pulp with peroxide, but without applying a bleaching liquor stabilized with silicate. Canadian patent 686,115 issued May 12, 1965 to Gard describes a process of adding hydrogen peroxide to wood pulp, mixing alkali with the so treated pulp and finally bleaching in a bleaching tower at a temperature of about 50° C. for a period of 90 to 120 minutes. To applicant's knowledge this system has not produced a satisfactory bleached pulp with the required degree of brightness.

U.S. Pat. No. 4,798,652 discloses an improved system for peroxide bleaching of mechanical pulps wherein the pulp is chelated and the peroxide together with a chelate is mixed with the pulp followed by the addition of caustic. The preferred implementation of this bleaching process includes the separating of residual peroxide and the reuse of the residual peroxide for bleaching a separate pulp.

It is also known to apply magnesium sulphate ($MgSO_4$) to pulp prior to the addition of peroxide. In Japanese patent publication 7844564 published Nov. 30, 1978 by Yotsuya, a system is disclosed to facilitate recovery of the pulp bleaching effluent. This system eliminated silicate which facilitated clarification of the residual bleach effluent, but did not provide a system capable of producing a bleached pulp having a brightness equivalent to that obtained when the conventional sodium silicate stabilizing bleaching liquor is used and thus is of limited interest for the commercial production of bleached pulps.

U.S. Pat. No. 4,731,161 describes a system for stabilizing a bleaching liquor by mixing magnesium ions and hydrogen peroxide prior to the addition of sodium hydroxide and using the liquor so produced to bleach kraft wood pulps.

BRIEF DESCRIPTION OF THE PRESENT INVENTION

It is an object of the present invention to provide a new bleaching system for bleaching mechanical pulps with peroxide substantially free of silicate to obtain a brightened pulp having a brightness at least equivalent to that obtainable when applying a bleaching liquor containing an equivalent amount of peroxide stabilized in the conventional manner with silicate.

Broadly the present invention relates to a method of brightening pulp using a peroxide substantially free of silicate to produce a brightened pulp of brightness substantially equivalent or better than that obtained using the equivalent amount of peroxide in a conventional silicate stabilized bleaching liquor comprising applying a chelating agent to the pulp and thickening the pulp to reduce the manganese content of the pulp to less than 30 parts per million (ppm) based on the dry weight of the pulp (and the copper content to less than 1 part per million), applying a solution of Group IIA ions to the pulp either before or after the application of the chelating agent or before or after thickening, said Group IIA ions being applied in the amount equivalent to the retention of at least 400 ppm magnesium based on the oven dry weight of the pulp, and dispersing the Group IIA ions substantially uniformly throughout the pulp, applying a bleaching liquor comprising peroxide and alkali with the alkali to peroxide ratio in the range between 1 and 2 to 1 in an amount to apply between 1 and 8% peroxide to the pulp based on the oven dried weight of the pulp, and retaining the so-treated pulp in a bleaching tower for sufficient time to obtain the required brightness.

Preferably Group IIA ions will be selected from calcium and magnesium ions.

Most preferably said Group IIA ions will be magnesium ions.

Preferably the bleaching liquor will contain between 0.01 and 0.1% magnesium sulphate ($MgSO_4$) based on the oven dry weight of the pulp.

Preferably the caustic to peroxide ratio will be in the range of 1.2 to 1.8 to 1 and magnesium sulphate will be present in the bleaching liquor applied to the pulp in the amount of about 0.04 to 0.06% based on the weight of the pulp.

Preferably the amount of magnesium ions added to the pulp before the addition of the bleaching liquor when bleaching at low consistency will be sufficient to retain 400 to 3,000 ppm Mg magnesium ions based on the oven dry weight of the pulp with a caustic to peroxide ratio of 1.2–1.6 to 1.

Preferably the amount of magnesium ions retained on the pulp will be equivalent to a retention of at least 1,000 ppm magnesium on the oven dry weight of the pulp when the bleaching is carried out at high consistency and said caustic to peroxide ratio will be in the range of 1.3–1.7 to 1.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
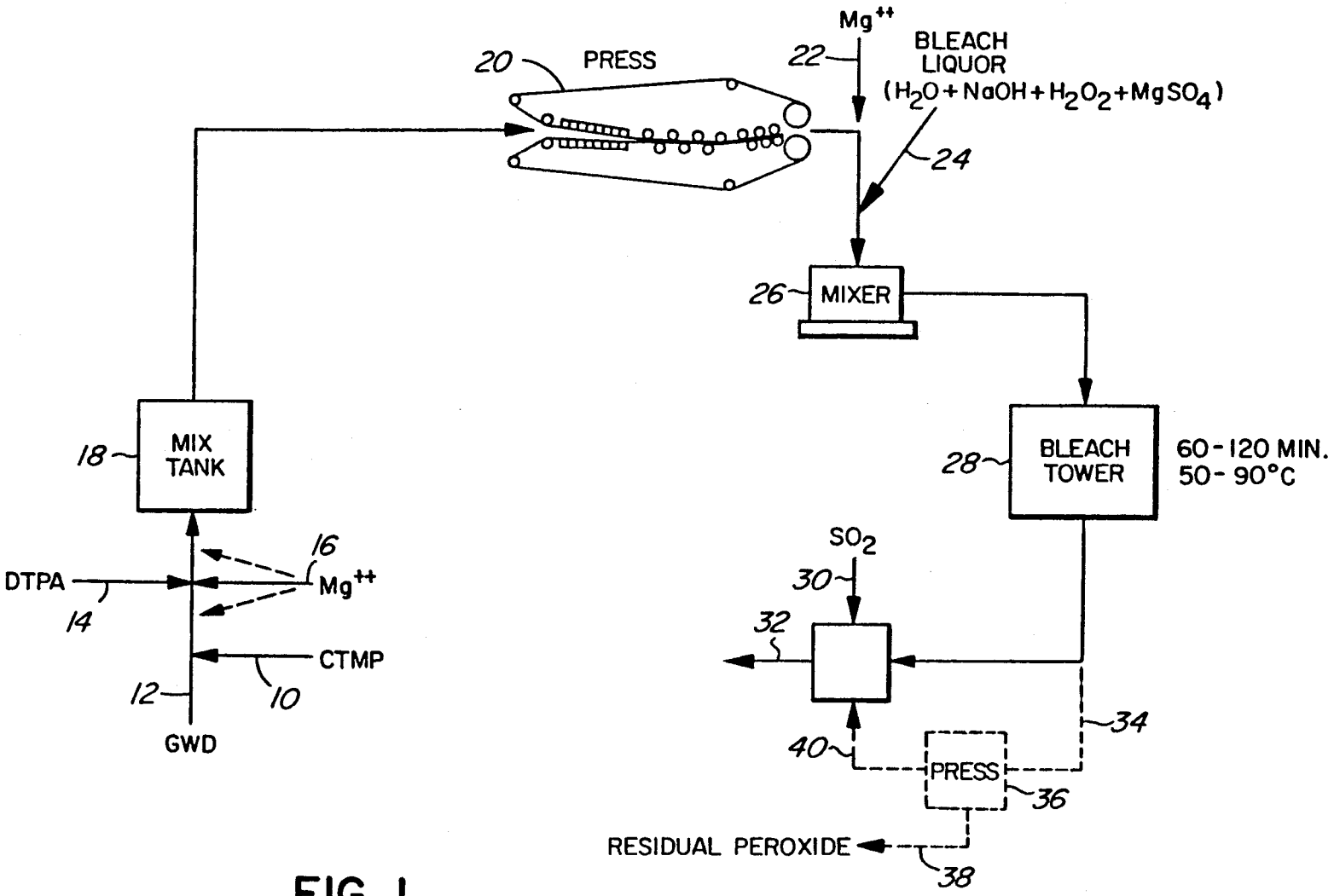
FIG. 1 is a schematic illustration of a flow diagram for the bleaching process of the present invention.

FIG. 1 is a schematic illustration of the process which shows the introduction of a pulp preferably a mechanical pulp such as a chemi-thermo-mechanical pulp 10 or groundwood pulp 12 or mixtures into the system and treatment of this pulp as indicated at 14 by the application of a suitable chelating agent such as sodium diethylene trimine penta-acetate (DTPA) or any other suitable chelating agent. The Group IIA ions which will normally be magnesium ions (Mg) as indicated at 16 may be introduced into the pulp either before, after or with the chelating agent as applied at 14. The pulp is then mixed as indicated at 18 with the chelating agent and the magnesium ions (normally provided in the form of magnesium sulphate) and then the pulp thickened in the press 20. This thickening will remove chelated metal ions to ensure that the amount of manganese (Mn) in the pulp is reduced within acceptable limits (less than 30 ppm) and copper (less than 1 ppm) but will also wash some of the magnesium ions from the pulp. Thus to maintain the desired quantity of magnesium ions in the pulp after washing it is essential to add an excess if the addition of $Mg^{++}$ is made before the press washer 20.

A further advantage of adding at least some Mg (up to about 1.5%) before pressing is to further reduce the Mn content of the pulp as described in detail in companion application 07/796,952 filed Nov. 25, 1991 inventor Fortier.

If desired, the ions may be added as indicated at 22 after the press 20 instead of at 16 or some may be added at 16 and some at 22, it being important that the required amount of magnesium ions be retained by and distributed throughout the pulp before the bleaching liquor is added to the pulp as indicated at 24.

The bleaching liquor is mixed with the high consistency pulp from the press (generally about 20 to 30% consistency) in the mixer 26 and the pulp containing the magnesium ions and bleaching liquor is then passed into a bleaching tower 28 where it is held at the desired consistency for the requisite amount of time at the requisite temperature to obtain the desired degree of bleaching. The bleached pulp is then removed from the tower and the illustrated system optionally soured by the application of $SO_2$ (or other acids) as indicated at 30. The pulp is then delivered to the pulp or paper machine as indicated by the arrow 32.

In some cases it may be desirable to recover residual peroxide from the bleached pulp. In this case the pulp from the tower 28 is fed as indicated via line 34 to the press washer 36 wherein residual peroxide is separated as indicated at 38 for reuse and the pulp passed as indicated via line 40 to the souring stage 30 and then used in the conventional manner.

The amounts of the magnesium ions applied and the characteristics of the bleach liquor must be specifically controlled to obtain the desired objectives of the present invention of producing a bleached pulp having a brightness equivalent to a similar pulp bleached using an equivalent amount of peroxide stabilized with sodium silicate in the conventional manner. To carry out the invention as above indicated it is also very important that the manganese (Mn) content be less than 30 ppm in the pulp being bleached and the Cu content be less than 1 ppm.

As indicated above, it is believed that other acceptable Group IIA ions should, when applied in the appropriate amount, have similar effects to those obtained using $Mg^{++}$ ions, however, for a number of reasons $Mg^{++}$ ions are preferred and the disclosure deals primarily with Mg ion added in the form of magnesium sulphate $MgSO_4$. Calcium ions have also been tried and found to be effective as will be described hereinbelow.

The results shown in FIGS. 2 to 10 inclusive were achieved at a consistency of 15% and temperature of 60° C. for a bleaching time of 90 minutes.

Figure 3:
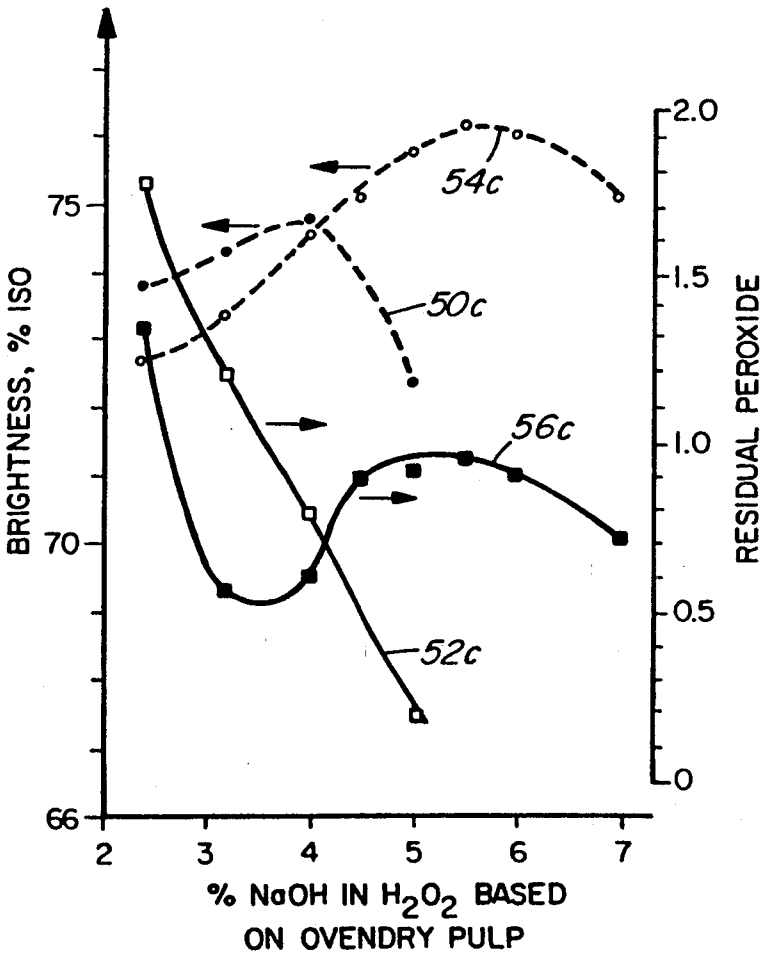
FIG. 3 shows plots similar to those in FIG. 2 but applied to a chemi-thermo-mechanical pulp.
Figure 2:
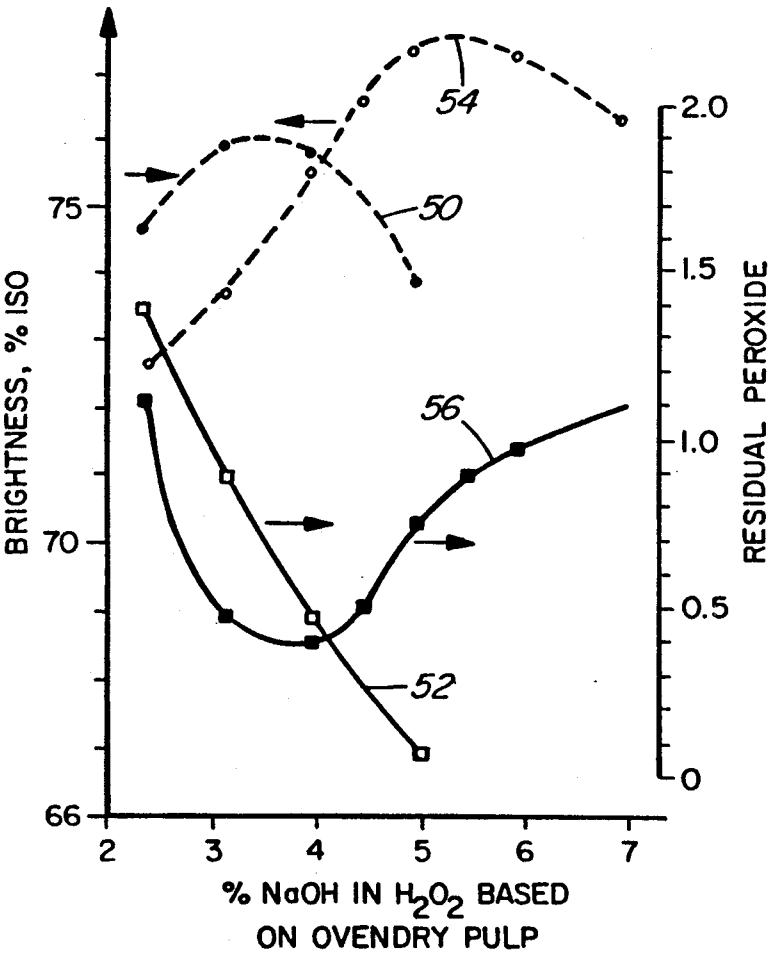
FIG. 2 is a plot of brightness and residual peroxide versus percent NaOH in the bleaching solution based on the oven dry weight of the pulp for the present invention and conventional silicate stabilized bleaching liquor applying substantially the same amount of peroxide to a groundwood pulp.

FIGS. 2 and 3 indicate some results that have been obtained when practising the present invention using magnesium sulphate and bleaching at a consistency of about 15%. As can be seen from the curve 50 the brightness obtained using the conventional process of sodium silicate stabilized hydrogen peroxide bleaching liquor applying 4% $H_2O_2$ to the oven dry pulp indicates that a maximum brightness for the particular pulp shown in FIG. 2 (groundwood pulp) of about 76 ISO was reached at a 3.5% NaOH based on oven dry pulp or a caustic to peroxide (hydrogen peroxide) ratio of less than 1, i.e. about 0.9. It will be noted that at this level of caustic in the conventional process the amount of residual peroxide was in the order of 0.7% of the dry weight of the pulp as indicated by the curve 52.

When practising the present invention at low (or medium) consistency (less than 20%), e.g., by pretreating the pulp with 2000 ppm Mg ions, based on the oven dry weight of the pulp (added as $MgSO_4$) followed by the application of 4% hydrogen peroxide based on the oven dry weight of the pulp and bleaching at low consistency (15%), the same groundwood showed a maximum brightness of about 2 points higher than that obtained using conventional process but required a caustic to peroxide ratio of greater than 1 (see curve 54). In this case approximately 5% caustic based on the oven dry weight of the pulp was necessary to maximize the brightness thus caustic to peroxide ratio required for maximizing brightness was about 1.25 to 1 when NaOH was used as the caustic and $H_2O_2$ was used as the peroxide.

The curve 56 illustrates the change in residual for different amounts of hydroxide in the bleaching liquor. It can be seen that at the maximum brightness the residual available is essentially the same as that available using the conventional silicate stabilized bleaching liquor. The curve for residual is a shape not previously seen and had a minimum at a caustic to peroxide ratio of about 1 to 1 and a maximum at a ratio approaching 2 to 1. When the bleaching was performed at high consistency (greater than 20%, e.g. 25% consistency) the amount of residual found to be available was lower.

Similar experiments to those described with respect to FIG. 2 were carried out using chemi-thermo-mechanical pulp, i.e. pulp in which the wood chips are treated with sulphite prior to refining and these results are shown in FIG. 3. Equivalent curves have been indicated by the same number as in FIG. 2 followed by the letter C. As above indicated bleaching at high consistency resulted in a significant reduction in the residual peroxide.

It can be see that with chemi-thermo-mechanical pulp the brightness obtained when practising the present invention was approximately 2 points higher than that obtained using the conventional process with the same peroxide addition. The residual $H_2O_2$ available from bleaching using the conventional process was similar to that obtained using the present invention at optimum caustic to peroxide ratio.

It will be apparen that the elimination of silicate from the bleaching liquor also significantly facilitates the recovery of residual peroxide.

It will be apparent in FIGS. 2 and 3 that provided the Mn (and Cu) content is acceptable (below Mn 30 ppm) and a higher caustic to peroxide ratio is maintained in the bleaching liquor brightened pulps equivalent to or brighter than that obtained using conventional silicate stabilized bleaching liquors are obtainable when practising the present invention.

Figure 4:
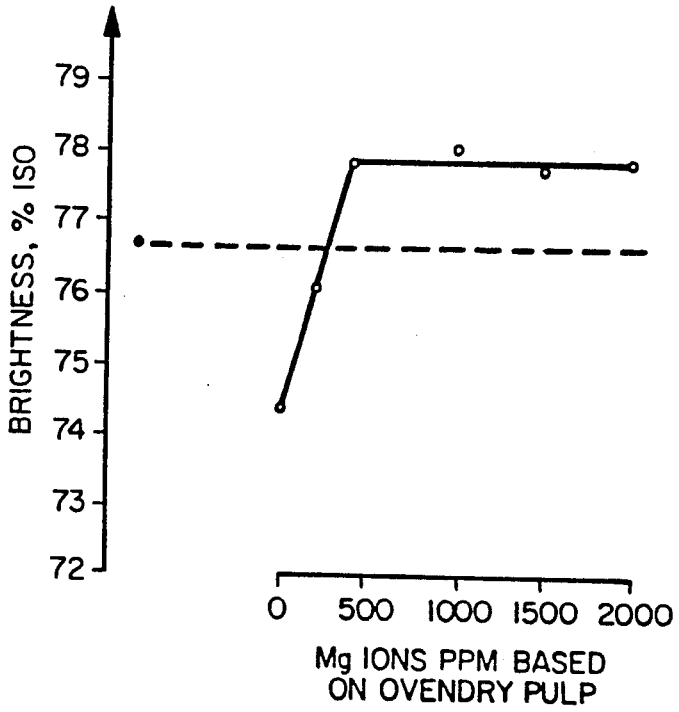
FIG. 4 is a plot of brightness versus degree of magnesium sulphate pretreatment for groundwood.
Figure 5:
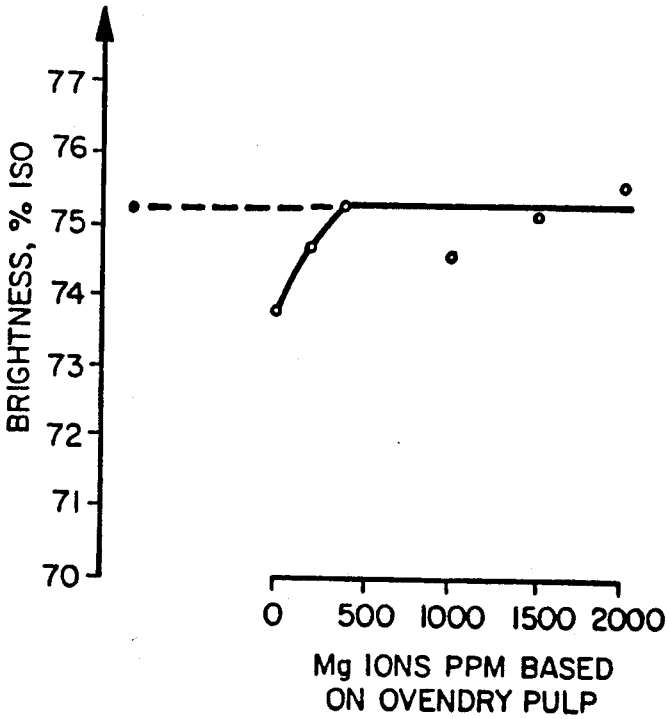
FIG. 5 is a plot similar to FIG. 4 for chemi-thermo-mechanical pulps.

FIGS. 4 and 5 clearly illustrate that unless the pulp is pretreated with at least about 0.2% magnesium sulphate retained in the pulp in the pretreatment stage, i.e. approximately 400 ppm magnesium ions retained on the pulps based on the dry weight of the pulp in the pretreatment stage, the brightness obtainable is limited and that increasing the amount of $Mg^{++}$ significantly beyond 400 ppm appears to have little bearing on the final brightness of the pulp. This was found when bleaching at low consistency, e.g. about 15% however it has been found that bleaching at higher consistency, i.e. for example 25%, the amount of $Mg^{++}$ necessary to attain the designed degree of brightening is increased to about 1000 ppm magnesium ions retained based on weight of the dry pulp.

Figure 6:
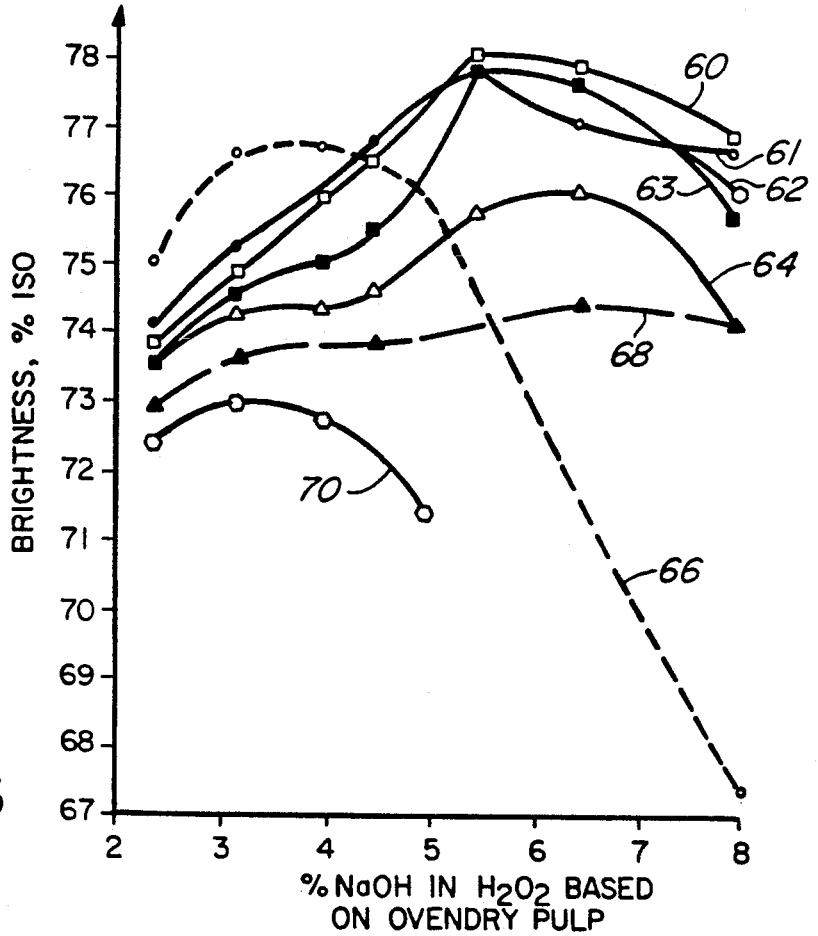
FIG. 6 shows brightness versus percent caustic for groundwood comparing various amounts of $MgSO_4$ pretreatment with a control using the conventional silicate stabilized bleaching liquor and the case wherein the bleach liquor contains magnesium sulphate but no silicate.

FIG. 6 shows the curves obtained when treating groundwood pretreated with varying amounts of magnesium sulphate and treated with 4% peroxide in accordance with the present invention or in accordance with the prior art.

Curves 60, 61, 62 and 63 depict pretreatment with 1000, 1400, 2000 and 400 ppm respectively of magnesium ions retained based on the oven dry weight of the pulp.

It will be noted that when the amount of magnesium ion applied in the pretreatment is reduced to 200 ppm as indicated by curve 64, a brightness equivalent to that obtained using the control, i.e. silicate stabilized brightening liquor (no magnesium sulphate pretreatment) (curve 66) was not achieved.

Curve 68 shown by the dash lines is for a pulp where no pretreatment with magnesium sulphate was applied and no silicate was used in the bleaching liquor, rather the bleaching liquor was modified to include magnesium ions in the amount of 1000 ppm based on the oven dry weight of the pulp. It will be apparent that the addition of magnesium sulphate to the bleaching liquor rather than as a pretreatment of the pulp was totally ineffective.

The dotted line curve 70 illustrates the results when no magnesium sulphate pretreatment was applied and no sodium silicate was incorporated in the bleaching liquor. The results obtained without following the prior art or the present invention clearly are unsatisfactory.

Figure 7:
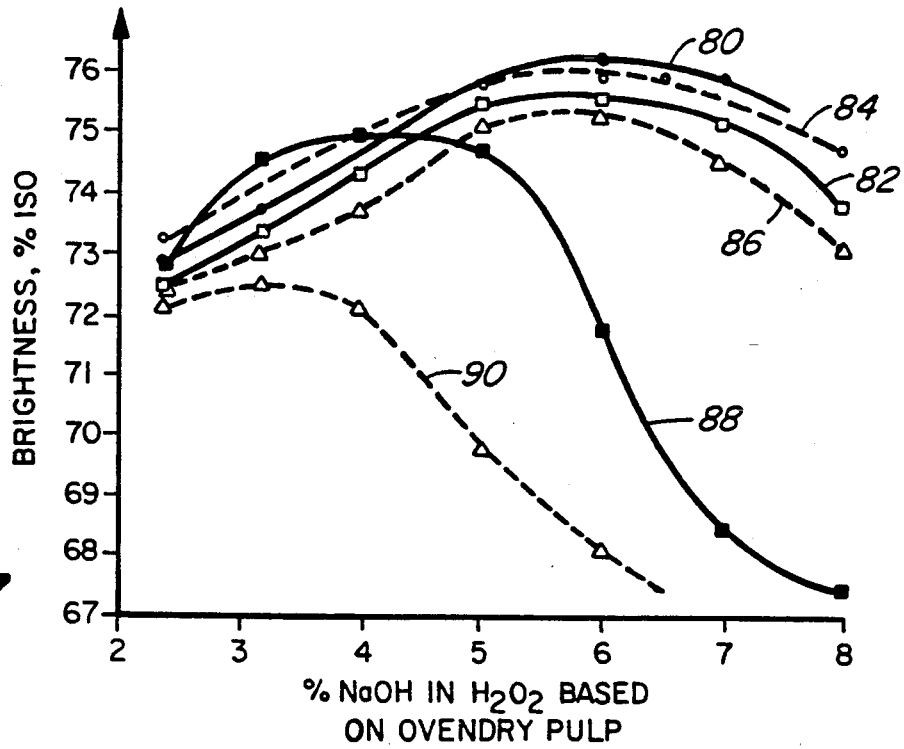
FIG. 7 is a comparison similar to that of FIG. 6 but for chemi-thermo-mechanical pulp.

FIG. 7 shows the effect of point of addition of the magnesium ions (magnesium sulphate) to the process, i.e. at point of addition indicated at 16 or 22 to a chemi-thermo-mechanical pulp. The curve 80 illustrates the addition of the magnesium sulphate at point 22 since the actual amount of magnesium sulphate added after thickening remains with the pulp when the bleaching liquor is added this curve illustrates a pulp containing 1000 ppm magnesium ions at the point of addition of the bleaching liquor. In all of the other curves in FIG. 7 the magnesium sulphate was added before thickening thus more magnesium sulphate had to be added to obtain the same 1000 ppm mg ions on the pulp and some of the magnesium was washed from the pulp during the thickening operation.

Curve 84 is similar to curve 82 but depicts a situation wherein after thickening the pulp was then diluted and the magnesium sulphate added, i.e. at location 22, then the pulp rethickened before the bleach liquor ($H_2O_2$) is added.

Similar results were obtained regardless of where or how the magnesium sulphate was added, for example, if the magnesium sulphate was added with or after the DPTA curves similar to curve 84 were obtained. When the pulp was first partially thickened then the magnesium sulphate added, curves indicated at 82 were obtained. The bottom curve 86 was obtained when the magnesium sulphate was added before the DPTA and this still produced satisfactory results as compared with the conventional system using the bleaching liquor stabilized with sodium silicate as indicated by curve 88, however it will be apparent, depending on where the $MgSO_4$ is added, the amount applied will be different to have the same amount present when the bleaching chemical is added. Curve 90 shows the addition of 1000 ppm magnesium ions to the bleaching liquor. No pretreatment was performed but 0.5% magnesium sulphate was added to the bleaching liquor and the pulp bleached. It will be apparent that curve 90 does not approach the brightness obtainable using the conventional process or the present invention.

Figure 8:
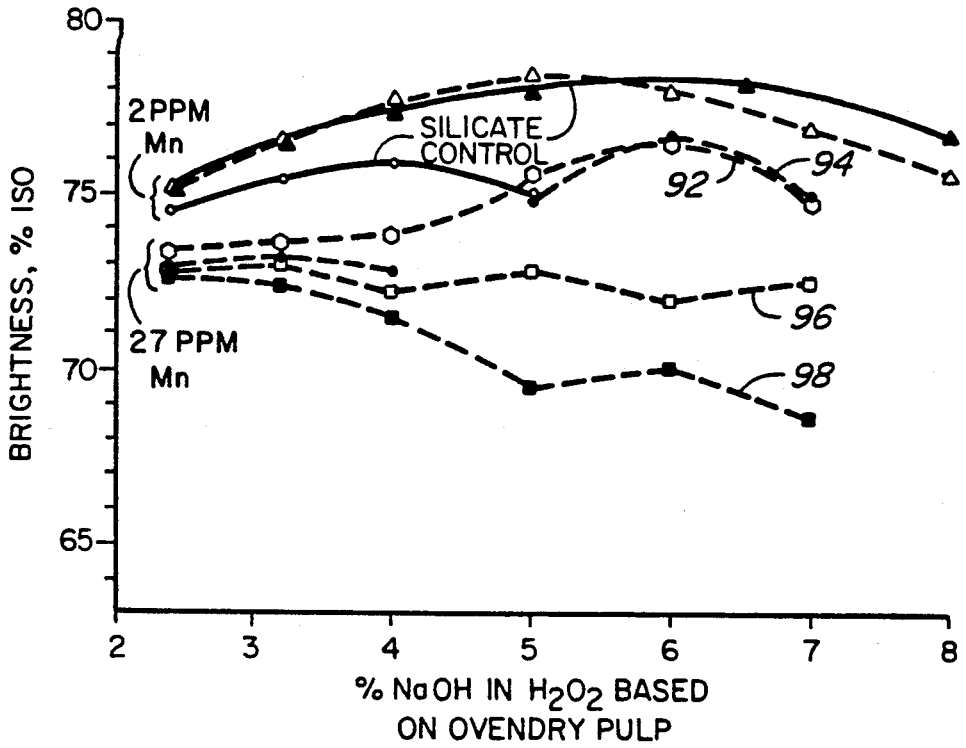
FIG. 8 illustrates brightness versus percent NaOH to oven dry pulp for treating groundwood pulps containing 2 to 27 parts per million of manganese based on the dry weight of the pulp.
Figure 9:
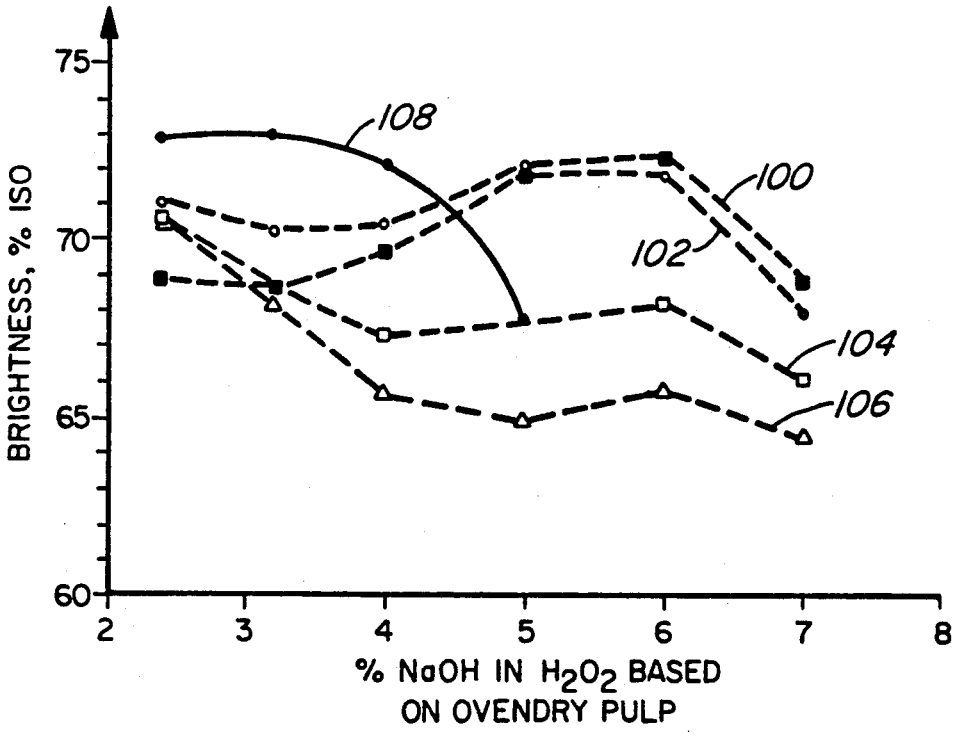
FIG. 9 is a graph similar to FIG. 8 for a mechanical pulp containing 50 parts per million of manganese.

The importance of the amount of manganese in the pulp to operation with the present invention is shown in FIGS. 8 and 9. The upper two curves in FIG. 8 are the results from treatment of a pulp containing two parts per million manganese and show that the present invention (dash lines) with magnesium ions in the range of 200 to 4000 ppm and the silicate control curves (solid line) produce similar results.

At 27 ppm manganese a pretreatment with greater than about 0.5% magnesium sulphate (1000 ppm magnesium ions) was essential to obtain the desired results (curves 92 and 94). It will be noted that 0.2% magnesium sulphate (400 ppm magnesium ions) and 0.1% magnesium sulphate (200 ppm magnesium ions) curves 96 and 98 respectively, the maximum brightness obtainable was less than that obtainable using the silicate control.

FIG. 9 shows treatment of a pulp containing 50 parts per million manganese and clearly illustrates that regardless of the amount of magnesium sulphate 2%, 1% and 0.5%, 0.2% and 0.1% $MgSO_4$ (curves 100, 102, 104 and 106 respectively) applied to pretreat of the pulp the resultant brightness or maximum brightness that could be achieved was always less than that obtained using the conventional system as indicated by the curve for silicate control curve 108.

It will thus be apparent that treatment of the pulp with DTPA or other chelating agents to reduce the manganese content to below 30 parts per million (or copper content to below a certain maximum which is believed to be approximately 1 part per million) is essential to obtaining the results of the present invention. In effect the cleaner the pulp being treated the better the results (higher the brightness).

Figure 10:
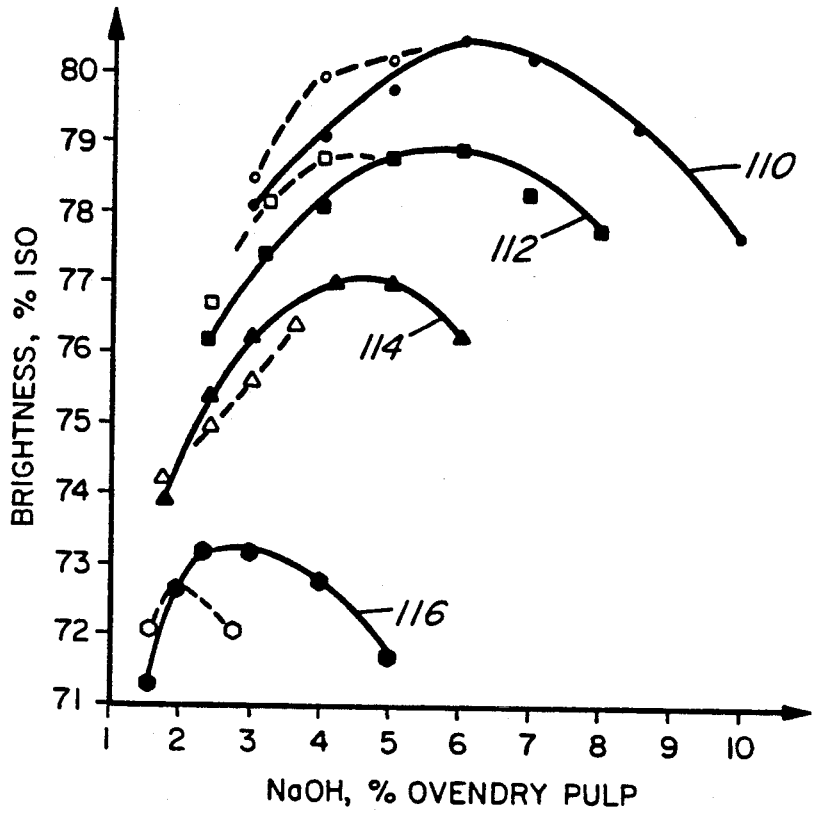
FIG. 10 shows curves similar to FIG. 6 but wherein calcium chloride is used in place of the magnesium sulphate.

A groundwood pulp was treated to apply 1% calcium chloride on the oven dry weight of the pulp in the same manner as the pretreatment with magnesium sulphate (the pulp was also treated with 0.2% of DTPA). After treatment with calcium the groundwood was bleached at a consistency of 15% with 2 to 5% peroxide with no sodium silicate present in the bleaching liquor. The results obtained are shown in FIG. 10 wherein the dotted lines indicate results obtained treating with sodium silicate stabilizer using the same amount of peroxide as in the adjacent solid line curve which indicates the results obtained when practising the present invention by applying calcium ions ($CaCl_2$) as opposed to magnesium ions. It will be apparent that the calcium is quite effective in obtaining the brightness, at least equivalent to the control. Curves 110, 112, 114 and 116 are for 5, 4, 3 and 2% peroxide applications respectively.

The bleaching liquor also should preferably contain magnesium sulphate as a stabilizer as it has been found that if the bleaching liquid does not contain minor amounts of magnesium sulphate its effectiveness may be reduced. Thus it is preferred that the bleaching liquor contain magnesium sulphate in the amounts of 0.01 to 0.1% by weight based on the oven dry weight of the pulp and preferably approximately 0.04 to 0.06% by weight based on the oven dry weight of the pulp.

Figure 11:
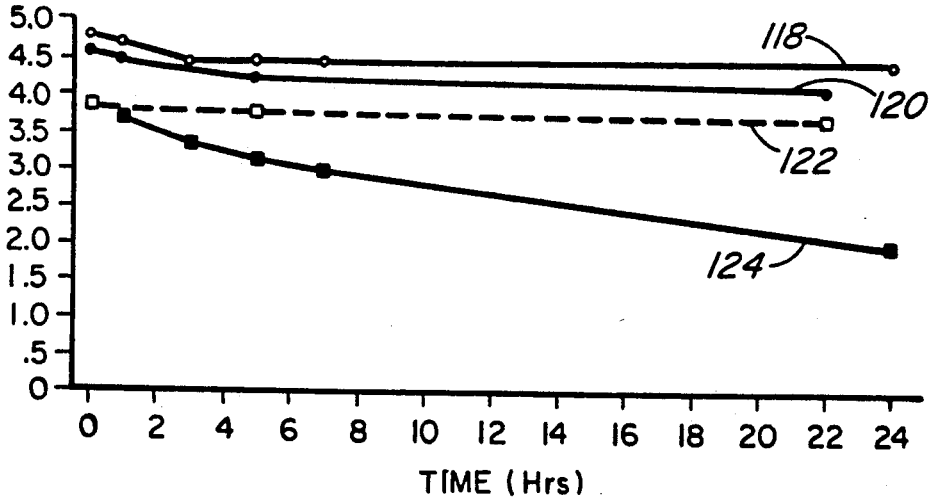
FIG. 11 shows the stability of hydrogen peroxide with time when stabilized in the conventional manner and in accordance with the invention and at different caustic applications.

The stability of the peroxide incorporating the sodium silicate is shown in dash lines in FIG. 11. The upper two curves 118 and 120 of this figure show the stability of $H_2O_2$ when 0.05% magnesium sulphate was added to the peroxide solution for two different caustic to peroxide ratios, the second from the bottom curve 122 is for conventional sodium silicate stabilized peroxide and the bottom curve 124 shows the effect of no stabilizer, i.e. no sodium silicate or magnesium sulphate was added to the hydrogen peroxide. In these tests where no stabilizer was used (curve 124) the ratio of caustic to peroxide was 1 to 1; the upper curve 118 the caustic to peroxide ratio was also 1 to 1; in the lower curve 120 illustrating conditions of 0.05% magnesium sulphate the caustic to peroxide ratio was 1.5 to 1; and the caustic peroxide ratio with the silicate stabilized peroxide curve 122 was 0.6 to 1.

It will be apparent that the addition of 0.05% magnesium sulphate to the peroxide solution maintains the stability of the peroxide even with a high caustic to peroxide ratios ($NaOH/H_2O_2$).

EXAMPLE 1

A pulp sample comprising 50% CTMP/50% stone groundwood and which included 0.15% DTPA and having a consistency of about 3.5% was obtained from a commercial mill.

Magnesium sulphate solution was added to this pulp at two different application rates (5.0% and 2.5% based on the oven dry weight of the pulp being treated). The resulting samples were thickened to about 33% consistency (Cs) as was a third sample to which no $MgSO_4$ was added. The thickened pulps had magnesium contents of 1190, 844 and 123 ppm, and manganese contents of 13, 14 and 26 ppm respectively. These samples are designated as pulps A, B and C respectively.

Each pulp was brightened at 60° C. for 90 minutes at 25% Cs, using 4% $H_2O_2$ application and a range of different NaOH application rates. Pulps A and B were brightened without addition of any sodium silicate. Pulp C was brightened without silicate and also brightened with the addition of 3.5 wt % of a 41 Baume sodium silicate solution. (This latter represents the conventional brightening process). In all cases the brightening liquor also contained 0.05% $MgSO_4$ (on dry pulp).

Figure 12:
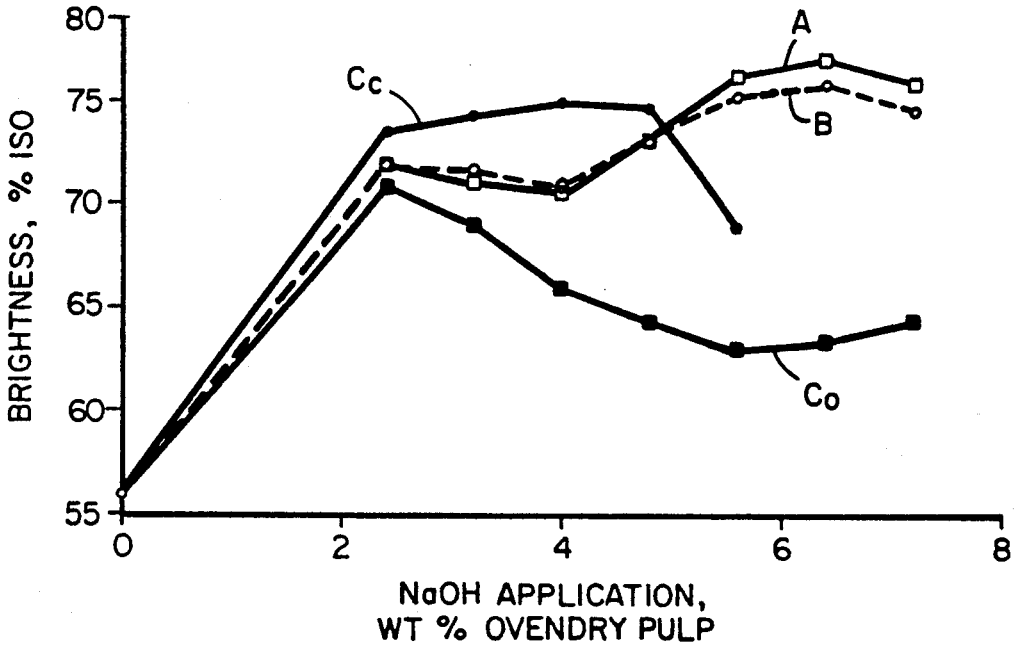
FIG. 12 shows the results obtained based on examples treating a pulp at high consistency, e.g., 25%.

Results are shown in FIG. 12. It can be seen that in the cases (curve A & B) where $MgSO_4$ was added as a pretreatment brightness levels equal to or greater than the silicate control (curve $C_c$) were obtained, provided an appropriate $NaOH/H_2O_2$ level was employed. When no silicate and no $MgSO_4$ addition was made prior to brightening liquor addition (curve $C_o$) very poor brightness levels were obtained, regardless of the NaOH level.

EXAMPLE 2

A second sample of CTMP pulp at a consistency of about 3.5% was obtained from the same mill. DTPA (0.2%) was added, and the pulp thickened to 15%. Magnesium sulphate (0.5% on O.D. pulp) was added to pretreat a first portion of this (pulp D). This pulp was brightened with 4% $H_2O_2$ and a range of NaOH application rates at a consistency of 15% and a temperature of 60° C. for 90 minutes. Another portion of the thickened pulp (without $MgSO_4$ pretreatment) was brightened with 4% $H_2O_2$ and 3.5% sodium silicate solution (41 Baume) (Pulp E) again using a range of NaOH levels at 15% consistency and 60° C. for 90 minutes. In all cases the brightening liquor also contained 0.05% $MgSO_4$ (on pulp), and brightening was at a consistency of 15%.

Figure 13:
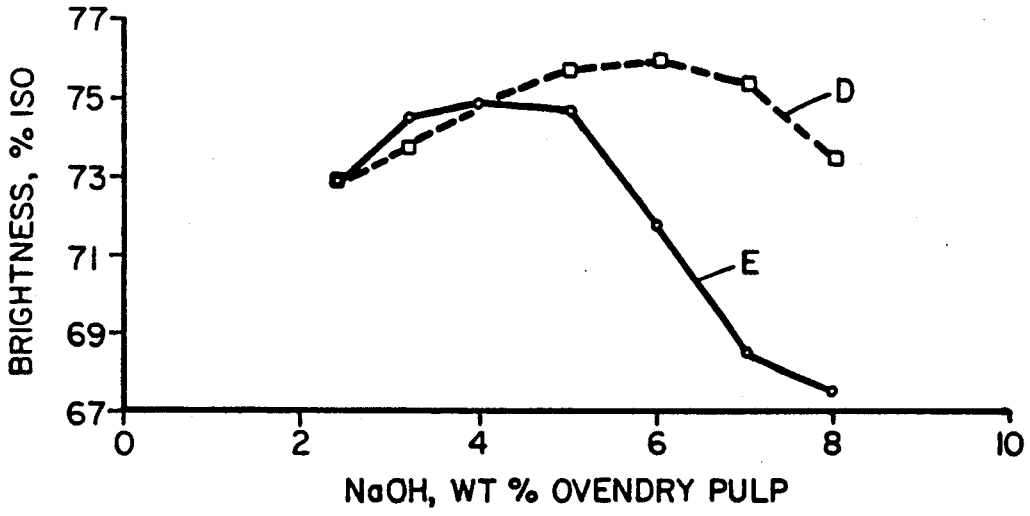
FIG. 13 shows similar curves to those of FIG. 12 but when a pulp was treated at a low consistency of 15%.

Results are shown in FIG. 13. It can be seen that $Mg^{++}$ ion pretreated pulp (the non-silicate) brightening process of the invention Curve D gave brightness levels greater than or equal to those for silicate treated Pulp E, (Curve E) provided an appropriate level of NaOH was applied.

Bleaching liquor may contain peroxide in the range of 1 to 8% but it is imperative when practising the present invention that the caustic to peroxide ratio be greater than 1 to 1 preferably less than about 2 to 1 when the caustic is sodium hydroxide and preferably will be in the range of about 1.2 to 1 to 1.8 to 1.

From the above it will be evident that the preferred ranges for bleaching at low consistency, i.e. 15%, the amount of $Mg^{++}$ ions in the pulp will preferably be in the range of 400 to 1400 ppm and the caustic to peroxide ratio will be in the range of 1.2–1.6 to 1 while for high consistency bleaching the amount of $Mg^{++}$ ions is increased to at least 1000 ppm and the caustic to peroxide ratio will preferably be in the range of 1.4–1.7 to 1.

Having described the invention, modifications will be evident to those skilled in the art without departing from the spirit of the invention as defined in the appended claims.

We claim:

1. A method of brightening mechanical pulp using a peroxide substantially free of silicate to produce a brightened pulp of brightness substantially equivalent or greater than that obtained using the equivalent amount of peroxide in a silicate stabilized bleaching liquor comprising applying a chelating agent to the pulp and thickening the pulp to reduce the manganese content of the pulp to less than 30 parts per million based on the dry weight of the pulp and the copper content to less than 1 part per million, applying a solution of Group IIA ions to the pulp, said Group IIA ions being applied in the amount equivalent to the application of at least 400 ppm magnesium ions retained on the pulp based on the oven dry weight of the pulp and dispersing the Group IIA ions substantially uniformly throughout the pulp, then applying a non-silicate stabilized bleaching liquor consisting essentially of peroxide and caustic with the caustic as sodium hydroxide to peroxide as hydrogen peroxide ratio in the range of 1 to 1 to less than 2 to 1 controlled to obtain a brightness substantially equivalent to or greater than that obtained using an equivalent amount of peroxide in a silicate stabilized bleaching liquor and applying said non-silicate stabilized bleaching liquor in an amount to apply between 1 and 8% peroxide to the pulp based on the oven dried weight of the pulp, retaining the so-treated pulp for sufficient time to obtain the required brightness.

2. A method as defined in claim 1 wherein said Group IIA ions are selected from the group consisting of calcium and magnesium ions.

3. A method as defined in claim 2 wherein said bleaching liquor contains between 0.01 and 0.1% magnesium sulphate based on the oven dry weight of the pulp.

4. A method as defined in claim 3 wherein magnesium sulphate is present in said bleaching liquor in the amount of about 0.04 to 0.06% based on the oven dry weight of the pulp.

5. A method as defined in claim 1 wherein said Group IIA ions are magnesium ions.

6. A method as defined in claim 5 wherein said bleaching liquor contains between 0.01 and 0.1% magnesium sulphate based on the oven dry weight of the pulp.

7. A method as defined in claim 6 wherein magnesium sulphate is present in said bleaching liquor in the amount of about 0.04 to 0.06% based on the oven dry weight of the pulp.

8. A method as defined in claim 7 wherein the amount of magnesium ions added to the pulp before the addition of the bleaching liquor is in the range of 400 to 3000 ppm $Mg^{++}$ retained on the pulp based on the oven dry weight of the pulp and said bleaching is carried out at a consistency of less than 20%.

9. A method as defined in claim 8 wherein said caustic to peroxide ratio is in the range of 1.2–1.8 to 1.

10. A method as defined in claim 7 wherein the amount of magnesium ions added to the pulp before the addition of the bleaching liquor is in the range of at least 1000 ppm $Mg^{++}$ retained on the pulp based on the oven dry weight of the pulp and said pulp is bleached at a consistency of greater than 20%.

11. A method as defined in claim 10 wherein said caustic to peroxide ratio is in the range of 1.3–1.7 to 1.

12. A method as defined in claim 7 wherein the amount of magnesium ions added to the pulp before the addition of the bleaching liquor is in the form of $MgSO_4$.

13. A method as defined in claim 7 wherein said caustic to peroxide ratio is in the range of 1.2–1.8 to 1.

14. A method as defined in claim 6 wherein the amount of magnesium ions added to the pulp before the addition of the bleaching liquor is in the range of 400 to 3000 ppm $Mg^{++}$ retained on the pulp based on the oven dry weight of the pulp and said bleaching is carried out at a consistency of less than 20%.

15. A method as defined in claim 14 wherein said caustic to peroxide ratio is in the range of 1.2–1.8 to 1.

16. A method as defined in claim 6 wherein the amount of magnesium ions added to the pulp before the addition of the bleaching liquor is in the range of at least 1000 ppm $Mg^{++}$ retained on the pulp based on the oven dry weight of the pulp and said pulp is bleached at a consistency of greater than 20%,.

17. A method as defined in claim 16 wherein said caustic to peroxide ratio is in the range of 1.3–1.7 to 1.

18. A method as defined in claim 6 wherein the amount of magnesium ions added to the pulp before the addition of the bleaching liquor is in the form of $MgSO_4$.

19. A method as defined in claim 6 wherein said caustic to peroxide ratio is in the range of 1.2–1.8 to 1.

20. A method as defined in claim 5 wherein the amount of magnesium ions added to the pulp before the addition of the bleaching liquor is in the range of 400 to 3000 ppm $Mg^{++}$ retained on the pulp based on the oven dry weight of the pulp and said bleaching is carried out at a consistency of less than 20%.

21. A method as defined in claim 20 wherein said caustic to peroxide ratio is in the range of 1.2–1.8 to 1.

22. A method as defined in claim 3 wherein the amount of magnesium ions added to the pulp before the addition of the bleaching liquor is in the range of at least 1000 ppm $Mg^{++}$ retained on the pulp based on the oven dry weight of the pulp and said pulp is bleached at a consistency of greater than 20%.

23. A method as defined in claim 22 wherein said caustic to peroxide ratio is in the range of 1.3–1.7 to 1.

24. A method as defined in claim 3 wherein the amount of magnesium ions added to the pulp before the addition of the bleaching liquor is in the form of $MgSO_4$.

25. A method as defined in claim 3 wherein said caustic to peroxide ratio is in the range of 1.2–1.8 to 1.

26. A method as defined in claim 1 wherein said bleaching liquor contains between 0.01 and 0.1% magnesium sulphate based on the oven dry weight of the pulp.

27. A method as defined in claim 4 wherein magnesium sulphate is present in said bleaching liquor in the amount of about 0.04 to 0.06% based on the oven dry weight of the pulp.

28. A method as defined in claim 1 wherein said caustic to peroxide ratio is in the range of 1.2–1.8 to 1.

* * * * *